US005386599A

United States Patent [19]

Cartwright

[11] Patent Number: 5,386,599

[45] **Date of Patent: * Feb. 7, 1995**

[54] PORTABLE SOFA AND BATHING UNIT

[76] Inventor: Floyd Cartwright, 310 Gelpi Dr., Lake Charles, La. 70601

[ * ] Notice: The portion of the term of this patent subsequent to Sep. 6, 2011 has been disclaimed.

[21] Appl. No.: 219,730

[22] Filed: Mar. 29, 1994

Related U.S. Application Data

[63] Continuation-in-part of Ser. No. 116,505, Sep. 3, 1993, Pat. No. 5,343,575.

[51] Int. Cl.[6] ..... A61H 33/02; A47K 4/00

[52] U.S. Cl. ..... 4/547; 4/546

[58] Field of Search ..... 4/547, 682, 546; 239/99, 101

[56] References Cited

U.S. PATENT DOCUMENTS

| | | | |
|---|---|---|---|
| 531,202 | 12/1894 | Maben | 4/547 |
| 569,001 | 10/1896 | Bock . | |
| 630,416 | 8/1899 | Smith . | |
| 652,744 | 7/1900 | Carman | 4/547 |
| 761,443 | 5/1904 | Buck . | |
| 1,077,199 | 10/1913 | James . | |
| 1,325,488 | 12/1919 | Mowat . | |
| 1,901,649 | 3/1933 | Huber | 4/682 |
| 2,471,302 | 5/1949 | Boward | 4/547 |
| 2,611,341 | 9/1952 | Paris . | |
| 2,876,020 | 3/1959 | Murchie . | |
| 3,157,774 | 11/1964 | Moore et al. . | |
| 3,860,977 | 1/1975 | Politz | 4/682 |
| 3,955,221 | 5/1976 | Finch . | |
| 3,963,179 | 6/1976 | Tomaro | 239/101 |
| 4,074,370 | 2/1978 | Harmony, III . | |
| 4,197,838 | 4/1980 | Shill . | |
| 4,207,629 | 6/1980 | Kagawa . | |
| 4,555,821 | 12/1985 | Page . | |
| 4,821,348 | 4/1989 | Pauna . | |
| 4,879,774 | 11/1989 | Sanders . | |
| 4,954,179 | 9/1990 | Fränninge . | |
| 5,038,421 | 8/1991 | Harris . | |
| 5,079,784 | 1/1992 | Rist et al. . | |

FOREIGN PATENT DOCUMENTS

| | | | |
|---|---|---|---|
| 1005387 | 4/1952 | France . | |
| 1282387 | 12/1961 | France . | |
| 3717963A1 | 12/1988 | Germany . | |
| 9932 | of 1902 | United Kingdom | 4/547 |

*Primary Examiner*—Henry J. Recla
*Assistant Examiner*—Charles R. Eloshway
*Attorney, Agent, or Firm*—Richard C. Litman

[57] ABSTRACT

A portable bathing unit for use in bathing bedridden patients is disclosed. The portable bathing unit includes a bath tub supported by a housing which is movably positionable in the proximity of a patient. Casters depend from the bottom of the housing to permit the portable bathing unit to be rolled in an upright posture. Additional casters are also attached to the rear of the housing which permit the portable bathing unit to be turned up on its rear and transported through narrow doorways. Water delivery and retrieval may be accomplished through the use of a submersible pump and a segment of conduit. Alternatively, a water delivery and retrieval may be accomplished through the use of an auxiliary faucet which is connected to an existing plumbing system. A hydrotherapeutical bath tub may be employed if desirable. Moreover, the bath tub may incorporate an overflow assembly to reduce the risk of water overflowing therefrom. When the bath tub is not in use, the portable bathing unit is convertible into an article of furniture. The housing forms armrests and a backrest, and a cover conceals the bathing chamber and forms a seat. A valance drapes around the bottom of the carriage to conceal the casters thereunder. It should be noted that the casters elevate the housing so as to permit the legs of a hoist to pass thereunder and permit the boom of the hoist to extend over the bath chamber.

27 Claims, 8 Drawing Sheets

PORTABLE SOFA AND BATHING UNIT

This is a continuation-in-part of application Serial No. 08/116,505 now Pat. No. 5,343,575

BACKGROUND OF THE INVENTION

1. FIELD OF THE INVENTION

The present invention relates to a bath tub and, more particularly, to a portable sofa and bathing unit.

2. DESCRIPTION OF THE PRIOR ART

Existing provisions for bathing a bedridden patient are limited. The patient must either be hoisted from his or her bed and transported to an existing bath tub or be given sponge bath while remaining in their bed. Difficulty arises in transporting a patient to and from a bath tub. Moreover, a risk of injury to a patient increases proportionally with the distance in which the patient must be transported to a bath tub. With respect to sponge baths, a patient receiving a sponge bath may not be cleaned as thoroughly as a patient receiving a bath in a bath tub. A need prevails for a portable bathing unit which may be transported to a location in the proximity of a patient.

Portable bathing devices have been the subject of patent protection in the prior art of record. For example, one such portable bathing device is disclosed in U.S. Pat. No. 2,611,341, issued Sep. 23, 1952 to Hugh P. Paris. Paris discloses a portable bathing device for bathing horses. The bathing device is adapted to be towed by a motor vehicle. Another portable bathing device is disclosed in U.S. Pat. No. 3,157,774, issued Nov. 17, 1964 to Jack E. Moore et al. Moore discloses a portable bath is configured so as to be used in providing physiological heat treatment. Another bathing device is disclosed in U.S. Pat. No. 4,074,370, issued Feb. 21, 1978 to George W. Harmony, III, who discloses a bathing apparatus intended for use in bathing bedridden patients. Another patent deemed of interest is U.S. Pat. No. 4,197,838, issued Apr. 15, 1980 to Wilson T. Shill, who discloses a birthing bath. In yet another patent, U.S. Pat. No. 4,207,629, issued Jun. 17, 1980 to Hideo Kagawa, a tub-bathing apparatus for bedridden and handicapped people is disclosed. It should be noted that not one of the above patents would be aesthetically appealing in a living environment.

A portable bathing device that could be convertible to an article of furniture, however, could be suitably located in a living environment. Such bathing devices have been the subject of patent protection. For example, U.S. Pat. Nos. 569,001, issued Oct. 6, 1896 to Johan Bock; 630,416, issued Aug. 8, 1899 to Samuel J. Smith; 652,744, issued Jul. 1, 1900 to Irving E. Carman; 761,443, issued May 31, 1904 to Frank R. Buck; and 1,077,199, issued Oct. 28, 1913 to Willard C. James, all disclose couches and bath tubs combined. Moreover, U.S. Pat. No. 630,416, issued Dec. 16, 1919 to Kenneth A. Mowat, discloses a bed or couch that may be suitably supported by a bath tub.

In addition to the aforementioned patents, another patent considered to be deemed of interest includes U.S. Pat. No. 4,821,348, issued Apr. 18, 1989 to Kenneth Pauna. Pauna discloses a convertible bed and bathroom combination. However, this combination is not convertible so as to form an article of furniture that would be aesthetically appealing in the setting of a home.

As inherent in the name, a "portable" bathing device should be easily transportable from one location to another. Though the employment of casters may assist in the transportation of a portable bathing device, the travel of the device may be gravely limited to the dimensions of the passageways through which the device is to be transported. Careful consideration of the structure and configuration of a portable bathing unit according to the present invention overcomes some of the difficulties associated with the transportation of the bathing units in accordance with the prior art of record.

Applicant's present invention is further adapted to be filled and drained while remaining free to be transported from one location to another. Suitable plumbing is provided to meet this requirement.

Moreover, the bathing device is convertible to an article of furniture that would be both aesthetically pleasing in a living environment.

In addition, the combined article of furniture and portable bathing unit may include auxiliary features, such as a hydrotherapy system. Examples of hydrotherapy systems are disclosed in U.S. Pat. Nos. 4,954,179, issued Sep. 4, 1990 to Thomas K. Fränninge; and 5,079,784, issued Jan. 14, 1992 to Bruno A. Rist et al.

The portable bathing unit according to applicant's instant invention is further configured to be sufficiently elevated to provide clearance to maneuver a hoist thereabout and thus, enable a patient to be easily hoisted into and from the bath chamber of the portable bathing unit.

The portable sofa and bathing unit according to the applicant's instant invention is structured and configured to bring to pass a resolution to the problems associated with the aforementioned existing portable bathing devices. None of the above patents, taken either singly or in combination, is seen to describe the instant invention as claimed.

SUMMARY OF THE INVENTION

The present invention is a portable bathing unit for use in bathing invalids or bedridden patients. The portable bathing unit is movably positionable in the proximity of a patient's bed and includes a bath tub supported by a housing. The housing is constructed of a rectangular frame and a plurality of panels. The frame is dimensioned so as to snugly receive a bath tub therein. The bath tub includes a bathing chamber dimensioned to accommodate an adult.

With the bath tub supported by the frame, panels are attached to the inner surfaces of the ends and the back of the frame forming inner end and rear walls of the housing. These panels extend downwardly to meet an upper surface of the bath tub and overlap a peripheral flange of the bath tub. A segment of trim extends longitudinally along the front of the housing to overlap the skirt of the bath tub. The panels in cooperation with the segment of trim hold the bath tub securely in the housing. Outer panels are attached to the outer surfaces of the frame forming outer end and rear walls of the housing. The housing should be aesthetically appealing so as to not detract from its environment.

Casters on the bottom of the housing permit the portable bathing unit to be moved in an upright posture. Casters are also attached to the outer rear wall of the housing which permits the portable bathing unit to be turned up on its rear wall and transported through most conventional size doorways.

Water delivery and retrieval may be accomplished through the use of a submersible pump and a segment of conduit, such as conventional garden hose. The portable bathing unit is filled by transferring water from an existing bath tub to the portable bathing unit via the submersible pump and segment of conduit. After use, the portable bathing unit is drained by transferring the water from the portable bathing unit to the existing tub.

Alternatively, an auxiliary faucet may be installed in the proximity of the portable bathing unit. Suitable conduit is provided for connecting the auxiliary faucet to the existing supply plumbing for retrieving hot and cold water therefrom. Waste conduit is provided for connecting the portable bathing unit drain to the existing waste plumbing for draining waste water from the portable bathing unit.

The portable bathing unit may include a hydrotherapeutical bath tub which operatively allows the user to customize the water flow through each hydrotherapeutical jet independently. Moreover, the portable bathing unit may include an overflow assembly to prevent water from overflowing from the bath tub.

When the portable bathing unit is not being used for bathing, the portable bathing unit is convertible into an article of furniture, such as a bed or a sofa. The end and rear walls of the housing extend upwardly beyond the upper surface of the bath tub so as to form armrests and a backrest. A cover conceals the bath chamber and forms a seat. The cover has a cushioned upper surface and is wrapped with a durable fabric. The lower surface of the cover may have a pair of handles extending therefrom which permit the cover to be easily maneuvered by the user. A valance drapes around the bottom of the housing to conceal the casters thereunder.

The portable bathing unit may be conveniently located in a patient's sleeping quarters to minimize the risk of harmful incidents which may otherwise occur while transporting a patient to and from the portable bathing unit. The casters elevate the frame high enough above the supporting surface to permit the legs of a hoist to pass thereunder and to permit the boom of the hoist extend over the bath chamber.

Accordingly, it is a principal object of the invention to provide a portable bathing unit for use in hospitals and/or with bedridden patients.

It is another object to provide that the portable bathing unit be moveable from one location to another notwithstanding substantially narrow doorways.

It is a further object that the portable bathing unit be filled from a remote location as well as drained to a remote location.

Still another object is that the portable bathing unit be comfortable for use by an adult.

It is yet another object that the portable bathing unit be convertible so as to form an article of furniture for sitting or lying upon when the bath tub is not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
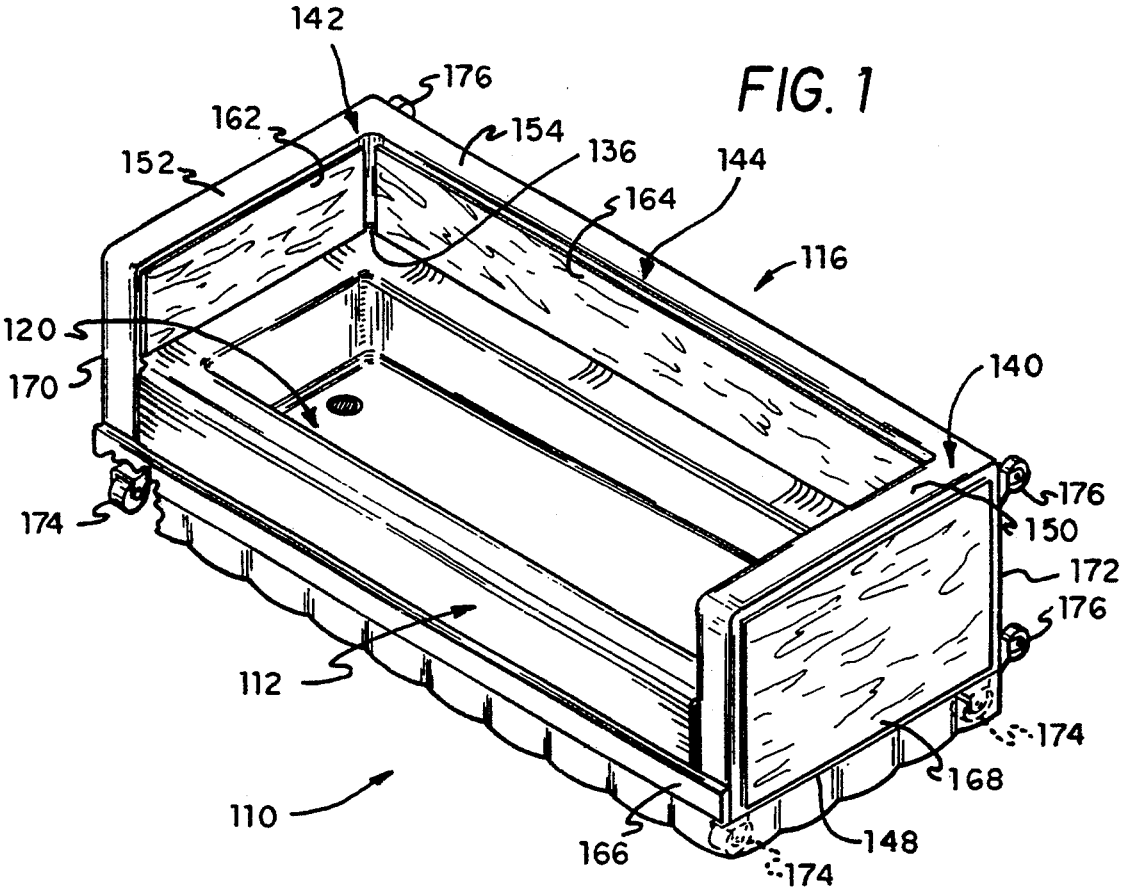
FIG. 1 is a partially cutaway, front perspective view of a portable bathing unit according to the present invention showing the bathing section revealed.

The present invention, as shown in FIG. 1, is a portable bathing unit 110 for use in bathing invalids or bedridden patients. The bathing unit 110 may be moved to a location proximate the invalid or patient. For example, in an institution, such as a hospital or a convalescence home, the bathing unit 110 may be transported from one room to another so as to independently serve a number of patients at their bedside. The bathing unit 110 includes a bathing section 112, a sofa section 114 (shown more clearly in FIGS. 7 and 8), and a housing 116.

Figure 2:
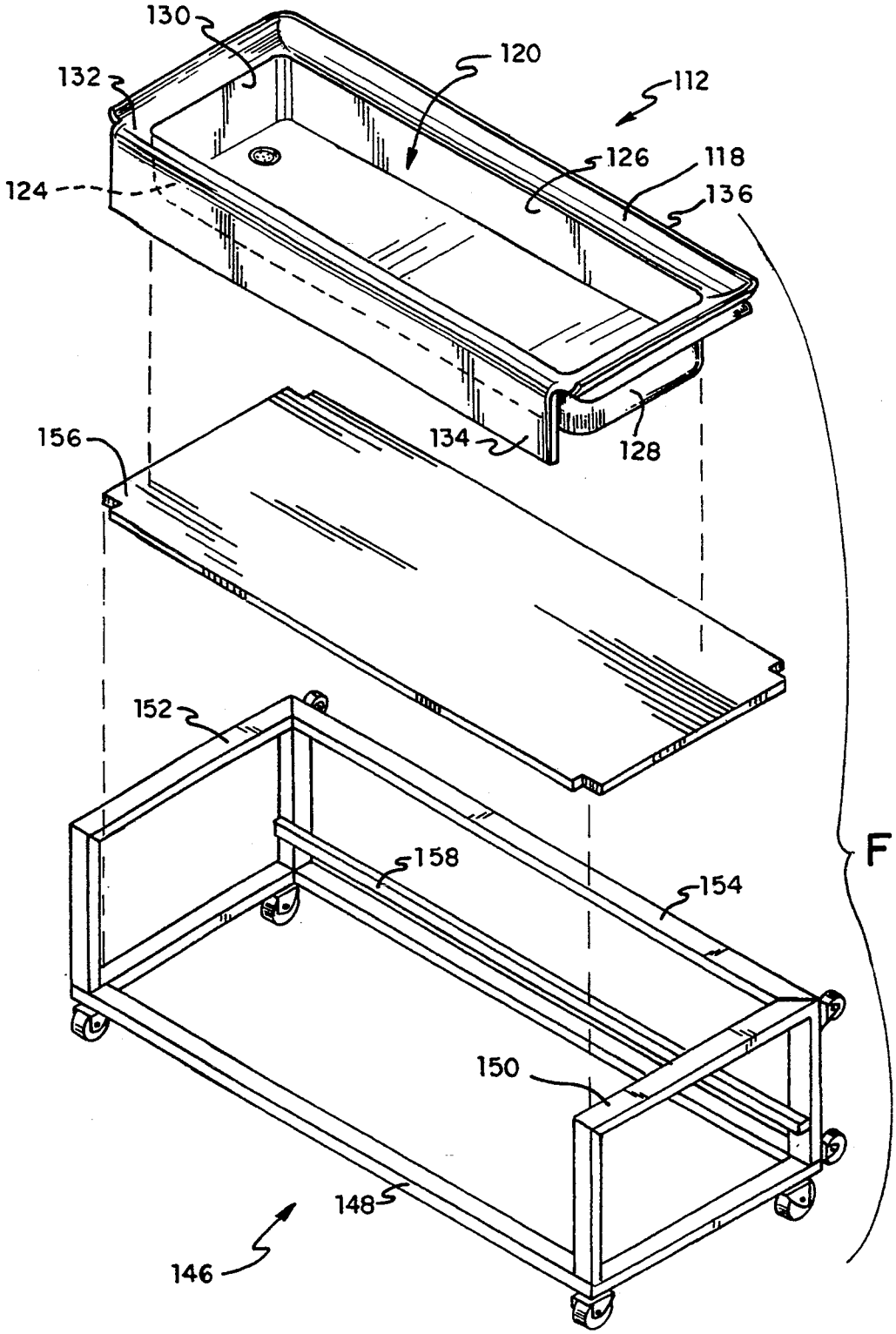
FIG. 2 is a partially exploded, partial front perspective view of the portable bathing unit.

As shown in FIG. 2, the bathing section 112 includes a bath tub 118 which is dimensioned and configured to facilitate in the bathing of an adult. It is preferable that the bath tub 118 be a separate component. Although the bath tub 118 is preferably molded from a fiberglass material covered with a conventional acrylic coating, it should be noted that the bath tub 118 may be molded from sturdy, yet lightweight, moldable materials other than fiberglass.

The minimum length and width of the bath tub 118 are preferably five feet (1.5 m) long and two and one-half feet (75 cm) wide, respectively. These are the approximate dimensions of a conventional bath tub. A bath tub having these dimensions should comfortably receive an adult therein.

The bath tub 118 includes a bathing chamber 120. The bathing chamber 120 is bounded by a bottom wall 122, a front wall 124, a rear wall 126, and two end walls 128, 130. The front wall 124, the rear wall 126, and the end walls 128, 130 each curve upwardly so as to be continuous with an upper surface 132. A forwardmost portion of the upper surface 132 curves forward and downward so as to be continuous with a front outer skirt 134. A rearwardmost portion and end portions of the upper surface 132 curve upward so as to be continuous with an upwardly extending peripheral flange 136.

The bath tub 118 is supported by the housing 116, as shown in FIG. 1. The housing 116 includes a bottom wall 138 (shown in FIG. 3), two end walls 140, 142, and a rear, or back, wall 144 structured and configured to snugly receive and support the bath tub 118. The bath tub 118 and the housing 116 are preferably configured separately so as to permit commercially available bath tubs to be used in the assembly of the portable bathing unit 110. Alternatively, the bath tub 118 may be integrally formed with the housing 116 to produce a portable bathing unit of unitary construction.

Referring back to FIG. 2, the housing 116 includes a frame 146 having a bottom 148, two laterally extending ends 150, 152 and a longitudinally extending rear 154. The frame 146 is preferably formed from a sturdy, yet lightweight, material, such as wood, fiberglass, or aluminum. The frame 146 should be capable of supporting at least 400 pounds (180 kg). Such a frame 146 should adequately support the weight of the bath tub 118 as well as the weight of the patient and the volume of water therein.

The bottom 150 of the frame 146 has attached thereto a subpanel 156, such as the ¾ inch (2 cm) thick sheet of plywood. The ends 150, 152 and the rear 154 of the frame 146 extend upwardly from the bottom 148 of the frame 146. The rear 145 of the frame 146 further extends between and is attached to the ends 150, 152 of the frame 146.

Figure 3:
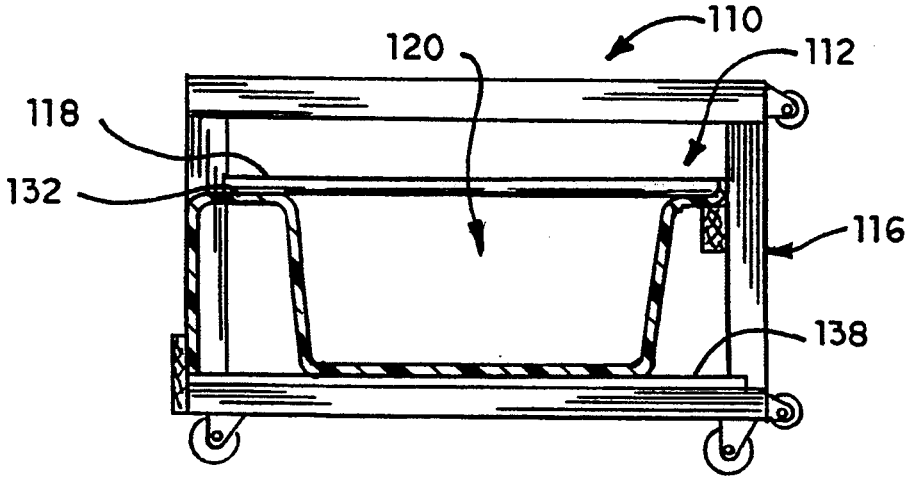
FIG. 3 is a cross-sectional view of the portable bathing unit.

A horizontal support 158 is disposed along the rear 154 of the frame 146 a predetermined distance upward from the bottom 148 of the frame 146. The horizontal support 158 extends the length of the rear 154 of the frame 146 from one end 150 of the frame 146 to the other end 152 of the frame 146. As shown in FIG. 3, a surface opposite a rearwardmost portion of the upper surface 132 of the bath tub 118 is vertically supported by the horizontal support 158. Further, a lower edge of the skirt 134 of the bath tub 118 is vertically supported by a forwardmost portion of the bottom wall 138 of the housing 116. In this way, the front and the rear of the bath tub 118 are vertically supported.

Referring back to FIG. 1, the housing 116 is shown to include inner end panels 160 (shown in FIG. 8), 162 and an inner rear panel 164. These inner panels 160, 162, 164 are shown respectively attached to the inner surfaces of the ends and rear 150, 152, 154 of the frame 146 so as to form the inner and rear surfaces of the end and rear walls 140, 142, 144, respectively. These inner panels 160, 162, 164 are constructed of a rigid material so as to provide sufficient backing about the periphery of the bath tub 118. Moreover, the thickness of the inner panels 160, 162, 164 preferably does not exceed a ¼ inch (0.6 cm) so as not to overlap an excessive portion of the upper surface 132 of the bath tub 118. With the bath tub 118 supported by the housing 116, the inner panels 160, 162, 164 extend downwardly so as to meet the end and rearwardmost portions of the upper surface 132 of the bath tub 118 and thereby overlap the peripheral flange 136.

A segment of trim 166 which extends longitudinally along a front of the housing 116 from one end wall 140 thereof to the other end wall 142 thereof. This segment of trim 166 extends upwardly from the bottom wall 144 (shown in FIG. 2) of the housing to overlap the skirt 134 or a portion of the skirt 134. The inner panels 160, 162, 164, in cooperation with the trim element 166, secure the bath tub 118 in a substantially fixed position within and relative to the housing 116.

Figure 6:
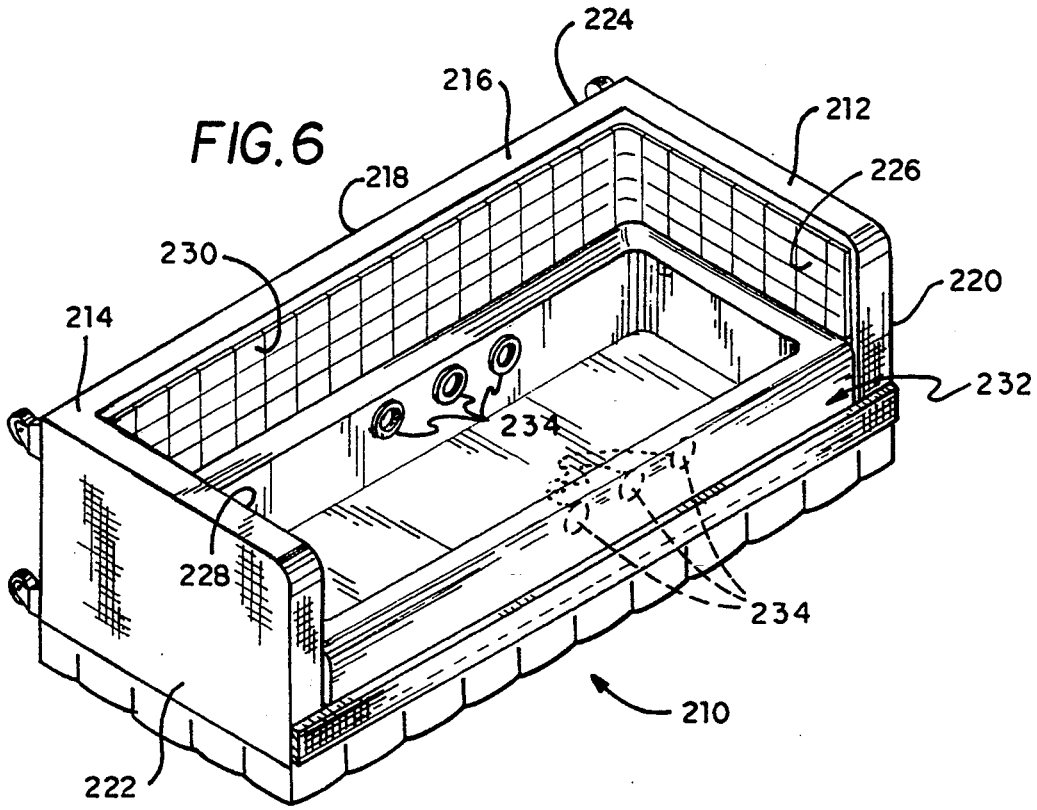
FIG. 6 is a perspective view of an alternative portable bathing unit.

The housing 116 also includes outer end panels 168, 170 and an outer rear panel 172. The outer end panels 168,170 (shown in FIG. 8) and the outer rear panel 172 are attached to outer surfaces of the ends 150, 152 of the frame 146 and the outer surfaces of the rear 154 of the frame 146, respectively. The end walls 140, 142 and rear wall 144 of the housing 116 and more particularly, the ends 150, 152 and rear 154 of the frame 146 as well as the inner and outer panels 160, 162, 164 and 168, 170, 172 of the housing 116 are preferably aesthetically appealing. The ends 150, 152 and rear 154 of the frame 146 and the outer panels 168, 170, 172 may be constructed of a decorative wood, such as that shown in FIG. 1, having a durable lacquer or epoxy finish. Alternatively, the ends 212, 214 and rear 216 of the frame 218 and the outer panels 220, 222, 224 may be padded and covered with a fabric covering, such as that shown in FIG. 6.

The inner panels 160, 162, 164 should be resistant to water which may overflow from, or be splashed from, the bathing chamber 120. Moreover, points of intersection between the inner panels 160, 162 and 164, and points of intersection between the inner panels 160, 162, 164 and the upper surface 132 of the bath tub 118, should be sealed so as to prevent water leakage thereabout. The inner panels may be coated with epoxy, similar to that of the inner panels 160, 162, 164 shown in FIG. 1; or may be surfaced with ceramic tiles, like that of the inner panels 226, 228, 230 shown in FIG. 6.

To enable the portable bathing unit 110 to be easily transported, a caster 174 is located on each one of the four corners of the underside of the bottom 148 of the frame 146. The casters 174 are preferably heavy duty casters capable of sustaining the weight of the bath tub 118 as well as the patient and the water therein. The casters 174 are preferably locking casters which prevent the frame 146 from inadvertently moving.

A caster 176 is also attached to each one of the four corners of the continuous rear flat outer surface of defined by the rear wall 144 of the housing 116. These casters 176 are disposed on the rear wall 144 of the housing 116 to permit the portable bathing unit 110 to be turned up on its rear wall 144 and, thereafter rolled and maneuvered through most conventional size doorways D.

Figure 4:
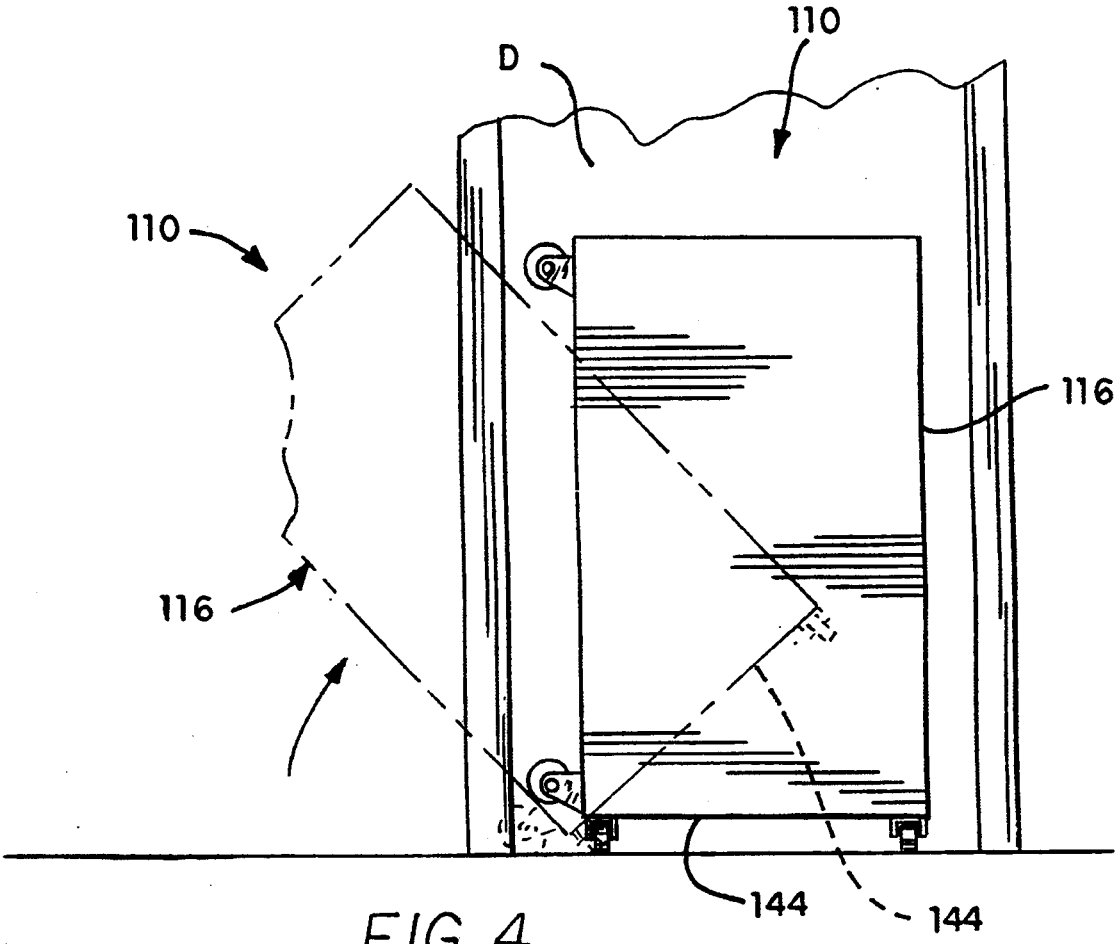
FIG. 4 is a diagrammatic representation, largely in elevation, of the portable bathing unit standing in an upright posture on the additional casters mounted on the rear surface of the housing.

For example, the portable bathing unit 110 shown in FIG. 4 is assembled with a commercially available bath tub. The overall dimensions of this portable bathing unit 110 are approximately seventy-two inches (1.8 m) in length, thirty-six inches (1 m) in width, and twenty-six inches (65 cm) in height. Such a portable bathing unit 110 would be difficult to maneuver through a doorway D in a upright posture. However, the casters 176 disposed on the rear wall 144 of the housing 116 permit the portable bathing unit 110 to be turned up on the rear wall 144 and rolled through the doorway D.

Figure 5:
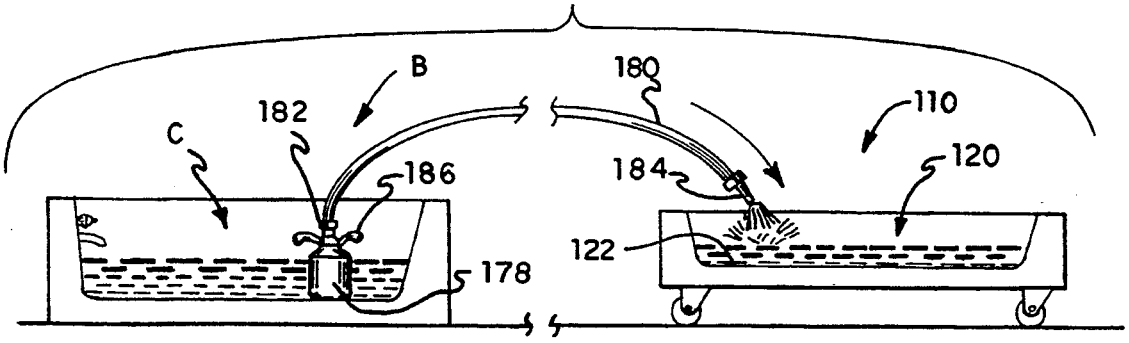
FIG. 5 is a diagrammatic representation of a water delivery and retrieval system for use with the present invention.

Referring to FIG. 5, water delivery and retrieval may be accomplished through the use of a submersible pump 178 and a segment of conduit 180, such as a segment of conventional garden hose. An inlet end 182 of the segment of conduit 180 is connected to an outlet port of the submersible pump 178.

To fill the portable bathing unit 110, an existing bath tub B is first filled with a desired amount of water. The submersible pump 178 is then submerged in the water filled bath tub B. An outlet end 184 of the segment of conduit 180 is placed in fluid communication with the bathing chamber 120 of the portable bathing unit 110. The submersible pump 178 is subsequently actuated to transmit water through the segment of conduit 180 from the existing bath tub B into the bathing chamber 120 of the portable bathing unit 110. Hence, the existing bath tub B is drained as the portable bathing unit 110 is filled.

To drain the waste water from the portable bathing unit 110, the submersible pump 178 is submerged in the bathing chamber 120 of the portable bathing unit 110 and the outlet end 184 of the segment of conduit 180 is placed in fluid communication with the bathing chamber C of the existing bath tub B. Upon actuating the submersible pump 178, the water is transferred through the segment of conduit 180 from the portable bathing unit 110 to the existing bath tub B, thereby draining the portable bathing unit 10 into the existing bath tub B.

The aforementioned configuration requires the use of only one submersible pump 178 and a single segment of conduit 180 of appropriate length. The portable bathing unit 110 can be in a remote location relative to an existing sink or bath tub, and existing faucets require no adaption for water delivery and retrieval.

The submersible pump 178 is preferably a ¼ HP (175 W) portable pump capable of pumping from pools as shallow as ½ inch (1 cm) deep and further capable of drawing water within ⅛ inch (3 mm) from the bottom wall 122 of the bathing chamber 120. The submersible pump 178 should have a screened bottom (not shown) for filtering the water flowing therethrough and should include a 1-¼ inch (3 cm) discharge and a ¾ inch (2 cm) adapter (also not shown) for connecting the inlet end 182 of the segment of conduit 180 thereto. The submersible pump 178 may further be provided with handles 186 to permit the submersible pump 178 to be easily transported.

Figure 10:
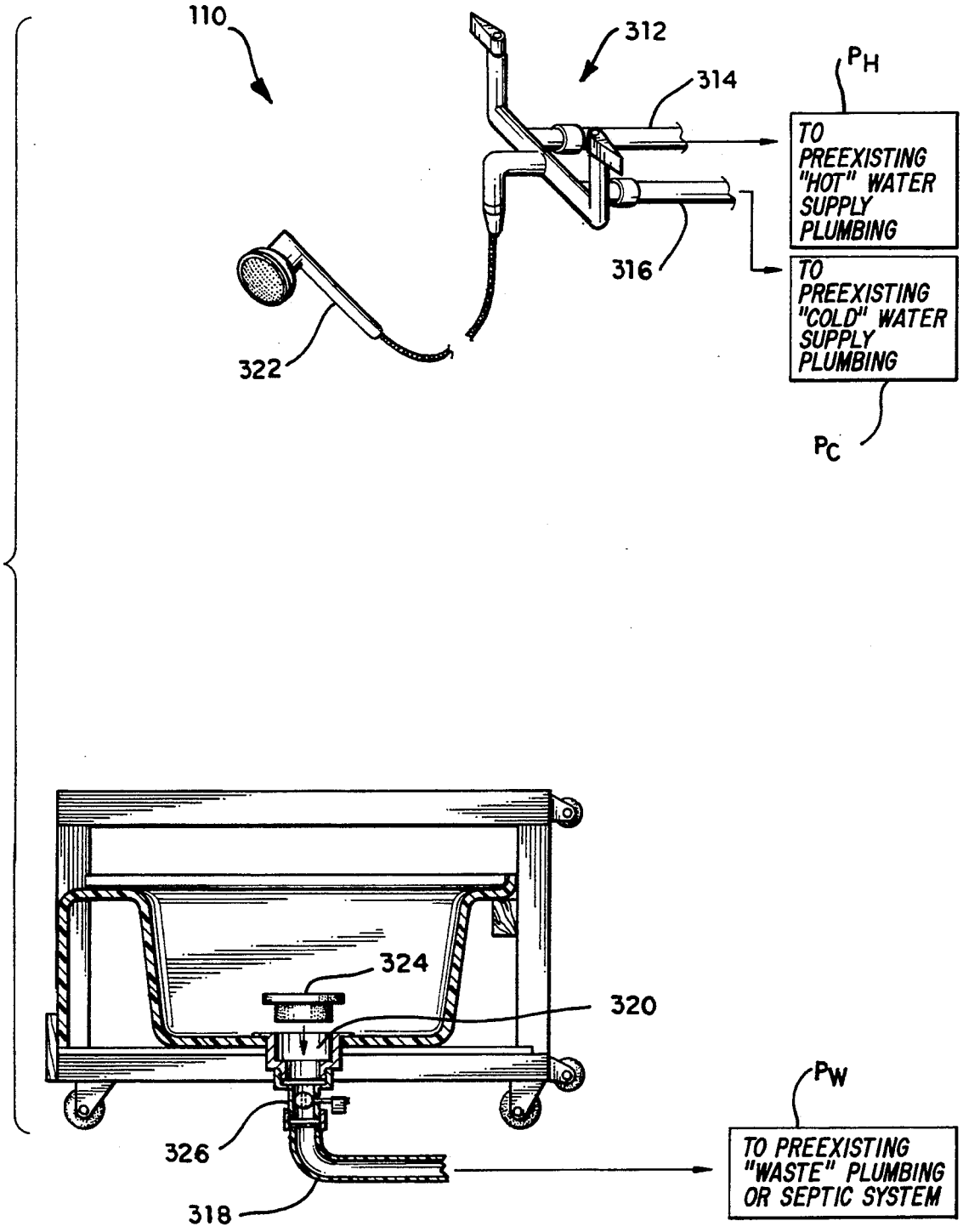
FIG. 10 is a partial diagrammatic representation of an alternative or supplemental water delivery and retrieval system largely in elevation.

Alternatively, water retrieval and delivery may be accomplished with a valve assembly, such as the auxiliary faucet 312 shown in FIG. 10. Suitable conduit 314, 316 is provide for connecting the auxiliary faucet 312 to existing supply plumbing $P_H$, $P_c$ for delivering hot and cold water from the existing supply plumbing $P_H$, $P_c$ to the auxiliary faucet 312. Moreover, conduit 318 is provided for connecting the drain 320 of the portable bathing unit 310 to existing waste plumbing $P_w$ for draining waste water from the portable bathing unit 310 through the existing waste plumbing $P_w$, or to the septic system.

In accordance with the foregoing alternative water retrieval and delivery configuration, a remote valve assembly, such as the shower head 322 shown, is preferably engageable with the auxiliary faucet 312. This permits the retrieval of water from the existing plumbing $P_H$, $P_c$ to be controlled from a location remote from the auxiliary faucet 312. According to this embodiment, the shower head 322 includes a manual control (not shown), such as a push bottom valve. The shower head 322 may be of a type that discharges fluid at continuous rate and/or may be of the type that discharges fluid in a pulsating manner, such as that of a shower massage head.

This portable bathing unit 310 includes a drain plug 324 for closing the drain 320, a drain valve 326 mounted in series with the drain 320 and the conduit 318 connected to the existing waste plumbing $P_w$. Any suitable valve may be employed. The drain valve 326 permits the control of waste water from the drain 320 through the conduit 318. The drain valve 326 may be closed prior to disconnecting the conduit 318 from the existing waste plumbing $P_w$. The drain valve 326 may be integral with the conduit 318, whereby upon closing the drain valve 326 and disconnecting the conduit 318 from the drain 320, the drain valve 326 may prevent waste water from draining out of the conduit 318. Alternatively, the drain valve 326 may be integral with the drain 320, whereby upon closing the drain valve 326 and disconnecting the conduit 318 from the drain 320, the drain valve 326 may prevent waste water from draining out of the drain 320.

This alternative water retrieval and delivery configuration is not permanently affixed to the portable bathing unit 310, and therefore renders the portable bathing unit 310 free to be transported from one location to another.

Figure 11:
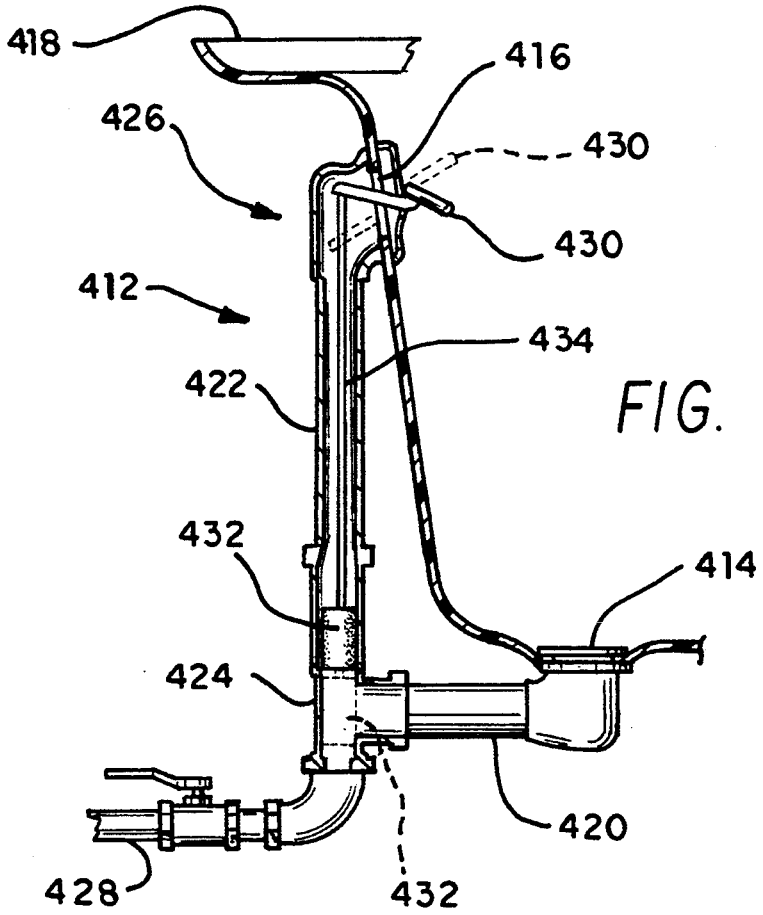
FIG. 11 is a partial cross-section, partially cutaway side elevational view of overflow assembly according to an alternative embodiment.
Figure 12:
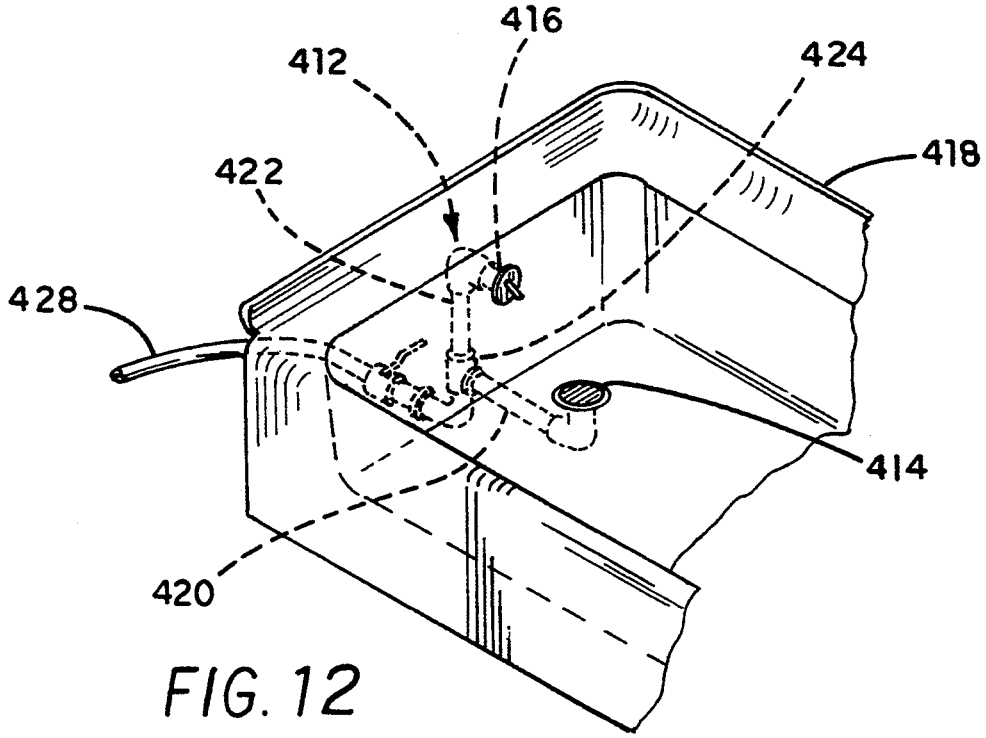
FIG. 12 is a perspective view of a bath tub showing the overflow assembly shown in FIG. 11 in hidden lines.

In accordance with yet another alternative, the portable bathing unit, as shown in part FIGS. 11 and 12, includes an overflow assembly 412. The overflow assembly 412 functions in cooperation with the drain 414 and overflow port 416 of the bath tub 418 of the portable bathing unit. The overflow assembly 412 basically includes a first segment conduit 420 connected to the drain 414, a second segment of conduit 422 connected to the overflow port 416, and a tee 424 for adjoining the first segment of conduit 420 to the second segment of conduit 422.

The second segment of conduit 422 contains a valve mechanism 426 which may be controlled to permit and prevent fluid flow through the drain 414. The valve mechanism 426 prevents fluid from flowing from the drain 414 while simultaneously permitting fluid entering through the overflow port 416 to be transmitted to the conduit 428 connected to the existing waste plumbing. The overflow assembly 412 reduces the risk of water overflow from the bath tub 418.

The valve mechanism 426 includes a control lever 430 located at the overflow port 416 of the bath tub 418, a plunger 432 slidably disposed in the tee 424, and a connecting rod 434 adjoining the control lever 430 and the plunger 432. With the control lever 430 in an initial position (shown in full), the plunger 432 renders the first segment of conduit 420 in fluid communication with the drain 414, thus permitting the waste water to be transmitted through the conduit 428 connected to the existing waste plumbing. Upon displacement of the control lever 430 from the initial position (shown in phantom lines), the plunger 432 obstructs the path of fluid flow between the first segment of conduit 420 and the drain 414 and, thereby permits the waste water from being transmitted to the existing waste plumbing.

Referring back to FIG. 6, the portable bathing unit 210 is shown to include a hydrotherapeutical bath tub 232. The hydrotherapeutical bath 232 includes six independently adjustable jets 234 and features a ¾ HP (550 W) jet system (not shown). The jet system includes a ¾ HP pump which operatively allows the user to customize the water flow through each jet 234 independently. The bath tub 232 preferably has a high gloss durable cast acrylic with a durable fiberglass backing. Such a bath tub 218 would enable the user to enjoy the therapeutic benefits of a massaging sensation while bathing or being bathed.

Figure 7:
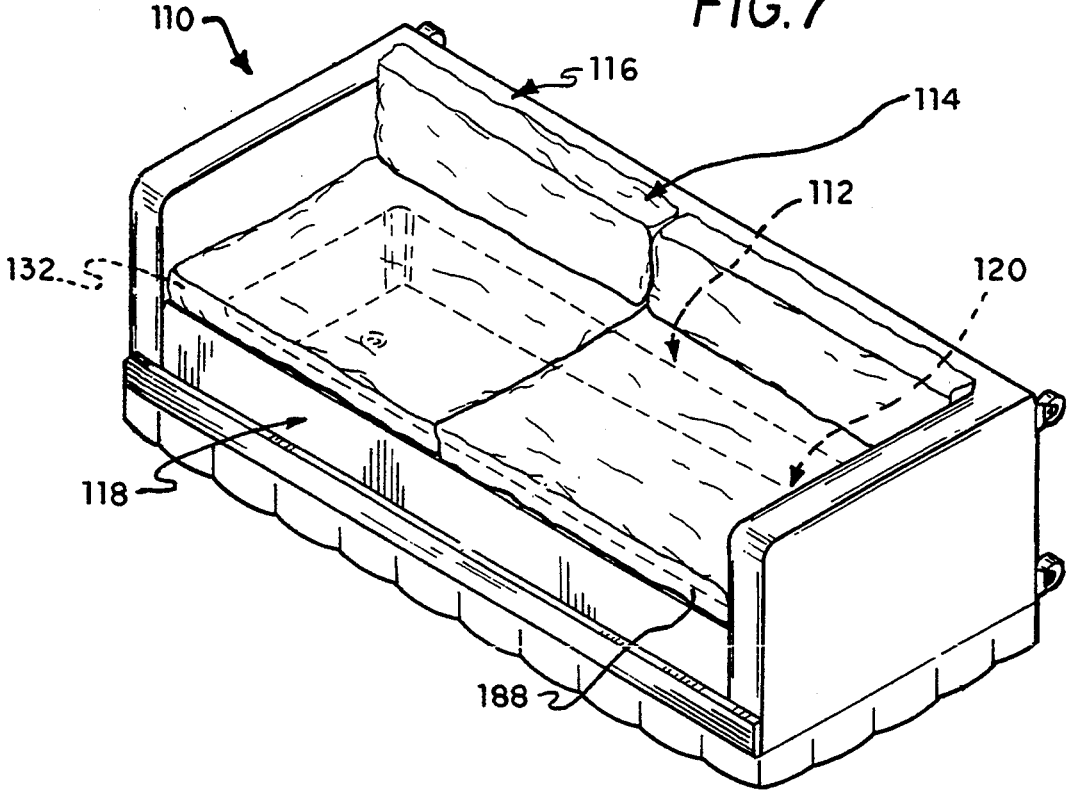
FIG. 7 is a perspective view of the portable bathing unit shown in FIG. 1 converted to a sofa.
Figure 8:
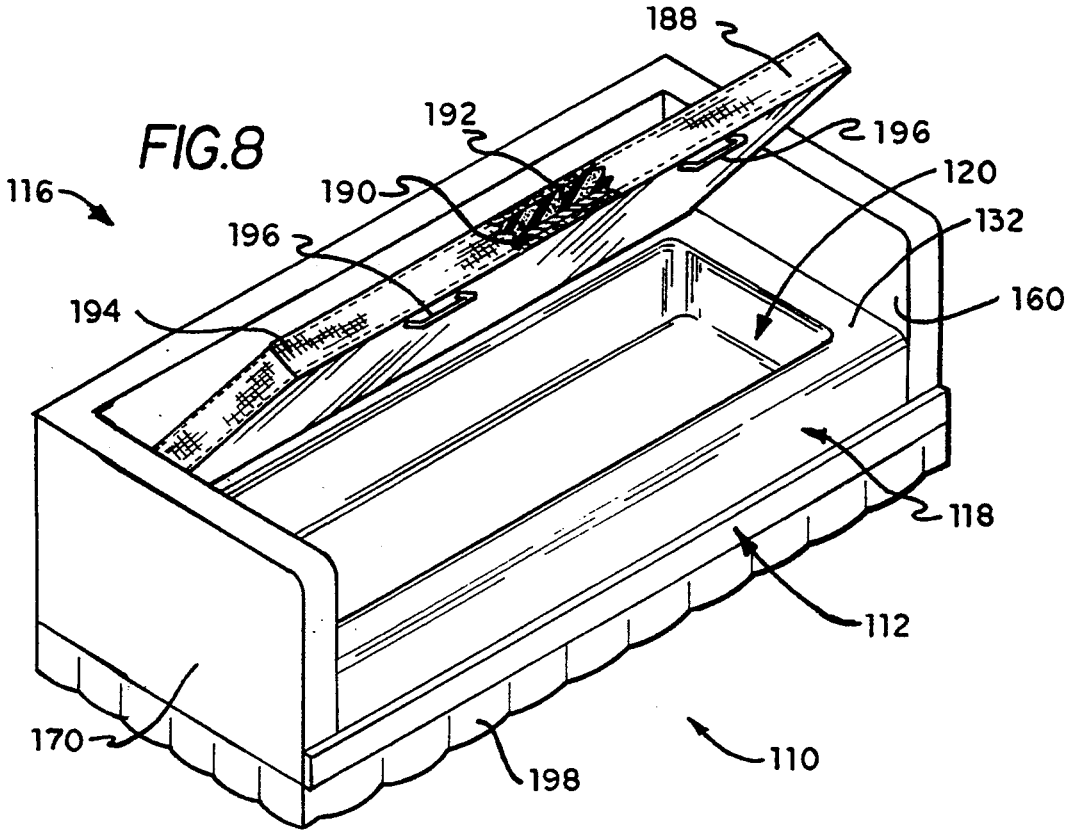
FIG. 8 is a partial perspective view of the sofa shown in FIG. 7 with the cover partially raised.

When the portable bathing unit is not being used for bathing, the bathing section 112 may be concealed by the sofa section 114. As shown in FIGS. 7 and 8, the portable bathing unit 110 is converted into the sofa section 114. The housing 116 extends upwardly over the upper surface 132 of the bath tub 118 forming armrests at the opposite ends of the bath tub 118 and a backrest along the rear of the bath tub 118.

A cover 188 conceals the bathing chamber 120 and forms a seat. The cover 188 is rectangular in shape and has dimensions which extend the length and width of the upper surface 132 of the bath tub 118. A planar panel 190 includes an upper surface and a lower surface. A cushion 192 is attached to the upper surface of the planar panel 190 and a durable fabric 194 is wrapped about both the planar panel 190 and the cushion 192. The fabric 194 may be of a leather or vinyl material which is non-absorbent and which may be effortlessly disinfected. The lower surface of the cover 188 may include a pair of handles 196 extending therefrom which permit the cover 188 to be easily handled and maneuvered by the user.

Around the bottom edge of the periphery of the housing 116 may drape therefrom a valance 198. The valance 198 is intended to mask the elevation of the housing 116 and conceal the casters 174 (shown in FIG. 1) attached to the bottom of the housing 116.

Figure 9:
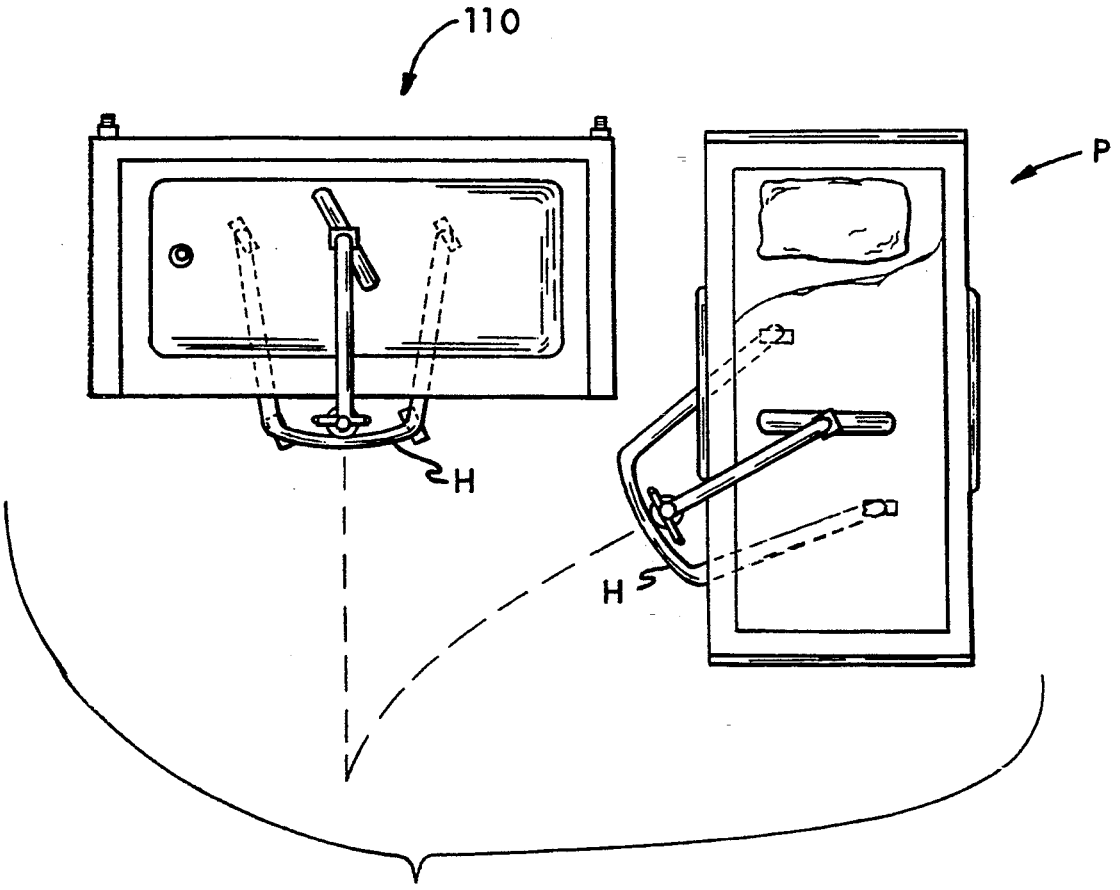
FIG. 9 is a diagrammatic representation of the portable bathing unit in proximity of a patient's bed and in cooperation with a hoist.

As shown in FIG. 9, the portable bathing unit 110 may be located in the proximity of the patient's bed P to ensure that a patient would be moved a minimum distance from the bed P. This reduces the risk of a harmful incident occurring in the course of transporting the patient to and from the portable bathing unit 110. The casters 174 (shown in FIG. 1) elevate the frame 146 (shown in FIG. 2) high enough above the floor surface to permit the legs of a hoist H to pass thereunder. Conventional baths typically are not elevated and, hence, do not easily accommodate a hoist H.

It is to be understood that the present invention is not limited to the embodiments described above, but encompasses any and all embodiments within the scope of the following claims.

I claim:

1. A portable unit comprising:
a bathing section, a sofa section, and a housing;
said bathing section including:
a bath tub supported by said housing and having a bathing chamber;
said sofa section including:
a cover member removably mounted on said bathing chamber;
a seat cushion supported by said cover member, and
a back cushion; and
said housing including:
a frame having a bottom on which said bath tub is supported;
a back wall extending upwardly from said bottom, and substantially above said bath tub, said back wall defining a continuous rear flat surface, said back cushion being removably supported by said back wall;
end walls extending upwardly from said bottom, and substantially above said bath tub; and
a plurality of casters mounted on said bottom of said frame and also mounted on said rear flat surface, whereby
said portable unit is rolled either upright or on its side.

2. A portable unit according to claim 1, further including:
means for delivering water to said bathing chamber.

3. A portable unit according to claim 2, wherein said said delivering means includes:
a faucet,
means for connecting said faucet to a preexisting plumbing supply system.

4. A portable unit according to claim 3, further including:
a manually controllable shower head; and
means for connecting said shower head to said faucet.

5. A portable unit according to claim 4, wherein said shower head selectively dispenses water continuously and in a succession of pulses.

6. A portable unit according to claim 5, further including:
a plurality of jets for circulating water in said bath tub.

7. A portable unit according to claim 1, further including:
means for discharging water from said bathing chamber.

8. A portable unit according to claim 7, wherein said discharging means includes a drain opening, and
means for selectively enabling water to, and preventing water from, discharging through said opening.

9. A portable unit according to claim 8, wherein said discharging means includes:
means for connecting said drain to a preexisting waste plumbing system.

10. A portable unit according to claim 9, further including:
a plurality of jets for circulating water in said bath tub.

11. A portable unit according to claim 8, wherein said means for selectively enabling water to, and preventing water from, discharging through said opening includes:
a drain overflow assembly.

12. A portable unit according to claim 11, wherein said discharging means includes:
means for connecting said drain overflow assembly to a preexisting waste plumbing system.

13. A portable unit according to claim 12, further including a plurality of jets for circulating water in said bath tub.

14. A portable unit according to claim 1, further including:
means for delivering water to said bathing chamber, and
means for discharging water from said bathing chamber.

15. A portable unit according to claim 14, wherein said
said delivering means includes:
a faucet,
means for connecting said faucet to a preexisting plumbing supply system.

16. A portable unit according to claim 15, further including:
a manually controllable shower head; and
means for connecting said shower head to said faucet.

17. A portable unit according to claim 16, wherein said shower head selectively dispenses water continuously and in a succession of pulses.

18. A portable unit according to claim 17, further including:
a plurality of jets for circulating water in said bath tub.

19. A portable unit according to claim 15, wherein said discharging means includes:
a drain opening, and means for selectively enabling water to, and preventing water from, discharging through said opening.

20. A portable unit according to claim 19, wherein said discharging means further includes:

means for connecting said drain opening to a preexisting waste plumbing system.

21. A portable unit according to claim 20, further including a plurality of jets for circulating water in said bath tub.

22. A portable unit according to claim 19, wherein said means for selectively enabling water to, and preventing water from, discharging through said opening includes:

a drain overflow assembly.

23. A portable unit according to claim 22, wherein said discharging means includes:

means for connecting said drain overflow assembly to a preexisting waste plumbing system.

24. A portable unit according to claim 22, further including a plurality of jets for circulating water in said bath tub.

25. A portable unit according to claim 1, further including:

means for delivering water to, and discharging water from, said bath tub.

26. A portable unit according to claim 25, wherein said means for delivering and discharging water includes:

a submersion pump, a segment of flexible conduit; and means for connecting said segment of conduit to said submersible pump, whereby said submersible pump delivers water to said bath chamber from a remote location and discharges water from said bath chamber to a remote location.

27. A portable unit according to claim 26, further including a plurality of jets for circulating water in said bath tub.

* * * * *